US005924935A

United States Patent [19]

Prewitt

[11] Patent Number: 5,924,935

[45] Date of Patent: Jul. 20, 1999

[54] GOLF SWING TRAINING DEVICE

[76] Inventor: Terry L. Prewitt, 9510-175th St. Ct. E, Puyallup, Wash. 98373

[21] Appl. No.: 09/054,253

[22] Filed: Apr. 2, 1998

[51] Int. Cl.[6] ..... A63B 69/36

[52] U.S. Cl. ..... 473/236; 473/242

[58] Field of Search ..... 473/257, 258, 473/259, 260, 261, 262, 263, 264, 265, 251, 242, 244, 236, 219, 223, 226, 227, 231

[56] References Cited

U.S. PATENT DOCUMENTS 3,021,141 2/1962 Polsky et al. .
3,194,564 7/1965 Swan .
5,011,153 4/1991 Watkins .
5,441,268 8/1995 Shier .
5,810,675 9/1998 Weathers .

*Primary Examiner*—Sebastiano Passaniti

[57] ABSTRACT

A new golf swing training device for providing a visual frame of reference for correctly completing the swing of a golf club having the training device installed thereon. Practice, or repetition of the swing of a golf club with the training device attached allows muscle memory to "remember" the correct motion when the golf club swing is performed without the training device. The inventive device includes a training device comprising a guidance device for removably attaching to a golf club, and a mounting means for removably mounting the guidance device to the golf club. The golf club is of the type having a shaft and a club head with a face.

14 Claims, 2 Drawing Sheets

GOLF SWING TRAINING DEVICE

BACKGROUND OF THE INVENTION

1. Field of the Invention

The present invention relates to golf swing practice devices and more particularly pertains to a new golf swing training device for providing a visual frame of reference for correctly completing the swing of a golf club having the training device installed thereon. Practice, or repetition of the swing of a golf club with the training device attached allows muscle memory to "remember" the correct motion when the golf club swing is performed without the training device.

2. Description of the Prior Art

The use of golf swing practice devices is known in the prior art. More specifically, golf swing practice devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art golf swing practice devices include U.S. Pat. No. 5,246,233; U.S. Pat. No. 5,411,266; U.S. Pat. No. 3,868,116; U.S. Pat. No. 5,441,270; U.S. Pat. No. 5,362,058; and U.S. Pat. No. Des. 264,866.

While these devices fulfill their respective, particular objectives and requirements, the aforementioned patents do not disclose a new golf swing training device. The inventive device includes a training device comprising a guidance device for removably attaching to a golf club, and a mounting means for removably mounting the guidance device to the golf club. The golf club is of the type having a shaft and a club head with a face.

In these respects, the golf swing training device according to the present invention substantially departs from the conventional concepts and designs of the prior art, and in so doing provides an apparatus primarily developed for the purpose of providing a visual frame of reference for correctly completing the swing of a golf club having the training device installed thereon. Practice, or repetition of the swing of a golf club with the training device attached allows muscle memory to "remember" the correct motion when the golf club swing is performed without the training device.

SUMMARY OF THE INVENTION

In view of the foregoing disadvantages inherent in the known types of golf swing practice devices now present in the prior art, the present invention provides a new golf swing training device construction wherein the same can be utilized for providing a visual frame of reference for correctly completing the swing of a golf club having the training device installed thereon. Practice, or repetition of the swing of a golf club with the training device attached allows muscle memory to "remember" the correct motion when the golf club swing is performed without the training device.

The general purpose of the present invention, which will be described subsequently in greater detail, is to provide a new golf swing training device apparatus and method which has many of the advantages of the golf swing practice devices mentioned heretofore and many novel features that result in a new golf swing training device which is not anticipated, rendered obvious, suggested, or even implied by any of the prior art golf swing practice devices, either alone or in any combination thereof.

To attain this, the present invention generally comprises a training device comprising a guidance device for removably attaching to a golf club, and a mounting means for removably mounting the guidance device to the golf club. The golf club is of the type having a shaft and a club head with a face.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new golf swing training device apparatus and method which has many of the advantages of the golf swing practice devices mentioned heretofore and many novel features that result in a new golf swing training device which is not anticipated, rendered obvious, suggested, or even implied by any of the prior art golf swing practice devices, either alone or in any combination thereof.

It is another object of the present invention to provide a new golf swing training device which may be easily and efficiently manufactured and marketed.

It is a further object of the present invention to provide a new golf swing training device which is of a durable and reliable construction.

An even further object of the present invention is to provide a new golf swing training device which is susceptible of a low cost of manufacture with regard to both materials and labor, and which accordingly is then susceptible of low prices of sale to the consuming public, thereby making such golf swing training device economically available to the buying public.

Still yet another object of the present invention is to provide a new golf swing training device which provides in the apparatuses and methods of the prior art some of the advantages thereof, while simultaneously overcoming some of the disadvantages normally associated therewith.

Still another object of the present invention is to provide a new golf swing training device for providing a visual frame of reference for correctly completing the swing of a golf club having the training device installed thereon. Practice, or repetition of the swing of a golf club with the training device attached allows muscle memory to "remember" the correct motion when the golf club swing is performed without the training device.

Yet another object of the present invention is to provide a new golf swing training device which includes a training device comprising a guidance device for removably attaching to a golf club, and a mounting means for removably mounting the guidance device to the golf club. The golf club is of the type having a shaft and a club head with a face.

Still yet another object of the present invention is to provide a new golf swing training device that may be rapidly configured for practice and may be adjusted to fit a variety of golf club head sizes and shaft diameters.

Even still another object of the present invention is to provide a new golf swing training device that provides a visual indication of the space between the golf ball and the proper direction of the swing of the golf club having the training device installed there.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
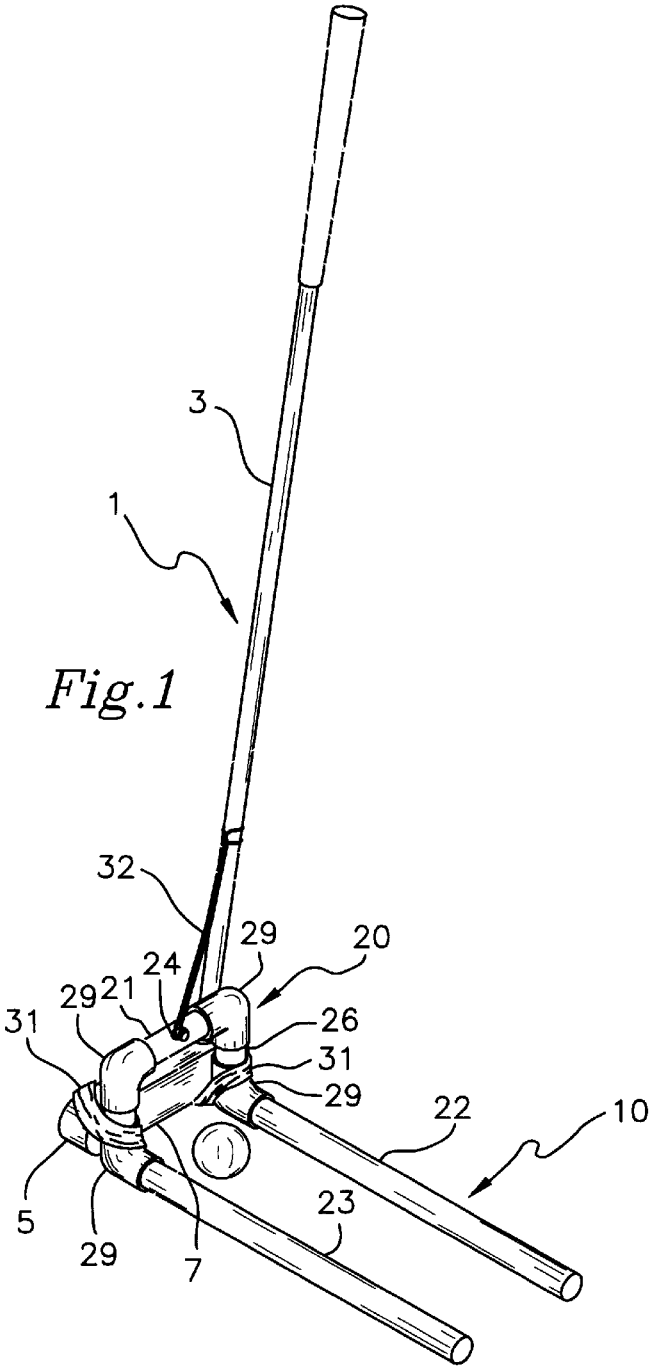
FIG. 1 is a schematic perspective view of a new golf swing training device as it is being used according to the present invention.
Figure 2:
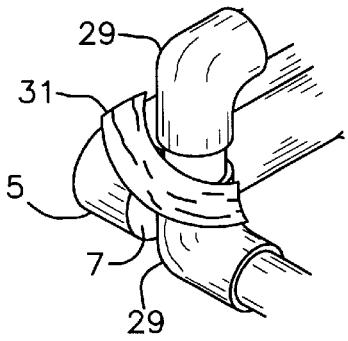
FIG. 2 is a schematic fragmentary view showing the elastomeric member mounting means of the present invention.
Figure 3:
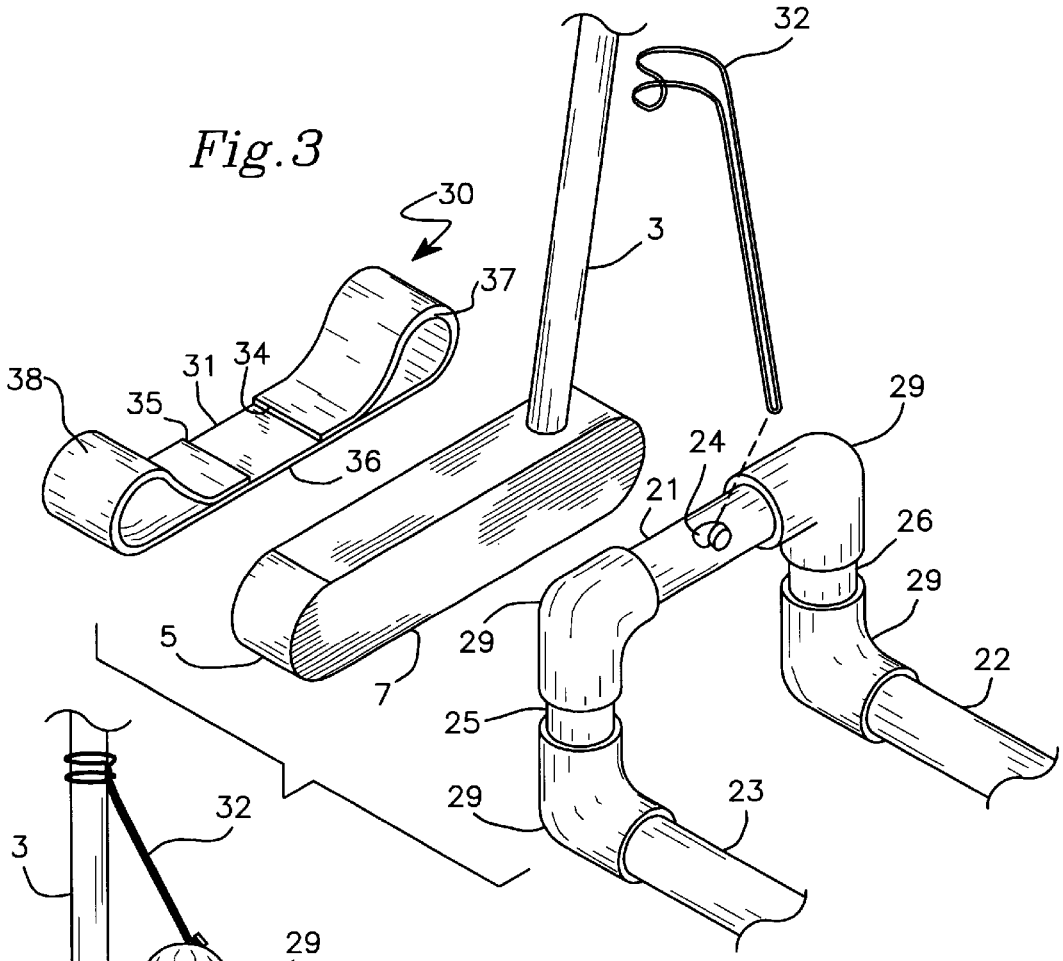
FIG. 3 is a schematic unassembled view of the components of the present invention.
Figure 4:
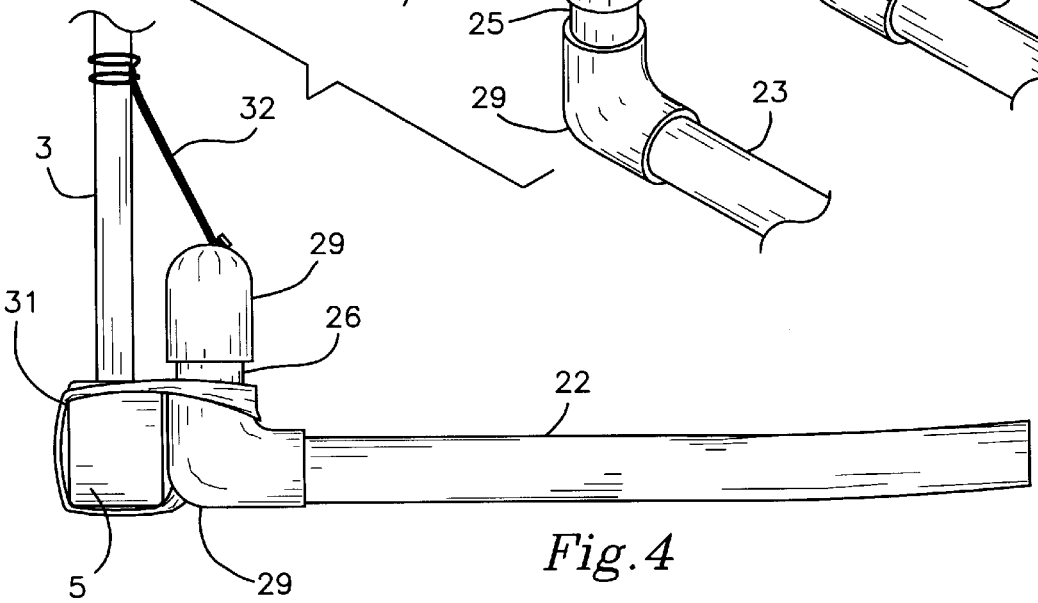
FIG. 4 is a schematic side view of the present invention.

With reference now to the drawings, and in particular to FIGS. 1 through 4 thereof, a new golf club swing training system embodying the principles and concepts of the present invention and generally designated by the reference numeral 10 will be described.

As best illustrated in FIGS. 1 through 4, the golf club swing training system 10 comprises a guidance device 20 for removably attaching to a golf club 1 and a mounting means 30 for removably mounting the guidance device 20 to the golf club 1. The golf club 1 is of the type having a shaft 3 and a club head 5 with a face 7.

The guidance device 20 comprises an elongate lateral base member 21 for removably mounting in a substantially parallel relationship to the face 7 of the golf club head 5. A pair of longitudinal guide members 22, 23 extend substantially perpendicularly from the lateral base member 21 for extending in a direction substantially perpendicular to the face 7 of the golf club 1 and substantially parallel to the swing direction of the golf club. The lateral base member 21 has a mounting nub 24 at a substantially central location thereon.

Each longitudinal guide member 22, 23 is curved along its length such that the longitudinal member 22, 23 curves upward with respect to the ground surface when the device 10 is mounted on a golf club 1. This upward curvature provides clearance so that the longitudinal guide members 22, 23 clear the ground surface during the swing motion of the golf club 1. The longitudinal guide members 22, 23 are preferably greater than thirteen inches in length, to provide the greatest visual reference throughout the club swing. Most preferably, the guide members are about thirteen and one-half inches long.

The longitudinal guide members 22, 23 are in a substantially parallel relationship. The longitudinal guide members 22, 23 are laterally spaced apart from each other. The most preferable range of separation widths between longitudinal guide member 22 and longitudinal guide member 23 is greater than about two times the width of a golf ball, but less than about three times the width of a golf ball. This separation distance is large enough to permit a smooth swing, but narrow enough to aid the user in implementing the correct swing. Preferably, the longitudinal guide members 22, 23 are spaced apart a distance greater than about two times the diameter of a golf ball to provide sufficient clearance between the guide members and a golf ball. The longitudinal guide members 22, 23 are also preferably spaced apart a distance less than about three times the diameter of a golf ball such that the members 22,23 are close enough to a golf ball there between to permit easy visual determination of equal spacing through the swing. Ideally, the separation width between the guide members 22, 23 is about 3¾ inches apart.

A pair of linking members 25, 26 are used to assemble the lateral base member 21 with the longitudinal guide members 22, 23. Each linking member 25, 26 extends between an end 62, 63 of lateral base member 21 and an end 27, 28 of a guide member 22, 23. Each linking member 25, 26 is oriented substantially perpendicularly to the lateral member 21 and substantially perpendicularly to the guide member 22. The linking members 25, 26 are thus adapted for positioning adjacent to and abutting against the face 7 of the golf club 1.

The most preferred lateral base member 21 has a substantially cylindrical shape. Each longitudinal guide member 22, 23 has a substantially cylindrical and arcuate shape, each linking member 25, 26 has a substantially cylindrical shape. Most preferably, the members are constructed from a substantially hollow plastic pipe to minimize the weight of the training device. The plastic longitudinal guide members 22, 23 are also more easily bent to the arcuate curvature preferred. Plastic pipe is an advantageous material because of its strength, and relative inexpensiveness.

The guidance device 20 additionally comprises connector angles 29 for each joining two of members together. Preferably, each connector angle 29 fixedly joins two members together in a substantially perpendicular relationship or orientation to each other. Most preferably, the connector angles 29 are formed from plastic pipe elbows to minimize weight.

Mounting means 30 serve to removably mount the guidance device 20 to a golf club 1 in a manner such that the longitudinal guide members 22, 23 extend in a perpendicular orientation with respect to the face 7 of the club head 5. The mounting means 30 comprises two elastomeric members, namely a first elastomeric member 31, and a second elastomeric member 32. The first elastomeric member 31 comprises an elongate elastic strap 33 having opposite ends 34, 35. Each end 34, 35 of the strap 31 is folded over onto itself and is fixed to a middle portion 36 of the strap such that the first elastomeric member 31 forms a pair of longitudinally spaced loops 37, 38. Each loop 37, 38 receives a portion of a guide member 22, 23 therethrough and a portion of the club head 5 to secure the guidance device 20 to the club head 5. A second elastomeric band 32 is for wrapping about a midportion of the shaft 3 of the golf club 1 and hooking about the mounting nub 24 on the lateral base member 21. The second elastomeric band 32 is placed such that there is tension between the shaft 3 and the lateral base member 21 to provide an upward force on the lateral base member.

In use, the golf swing training system 10 removably mounts on a golf club 1 of the type having a shaft 3 and a club head 5 with a face 7. To mount the device 10, the loop 37, 38 on the elastic strap 33 is stretched over the base member end 62, 63. A longitudinal guide member 22, 23 is then inserted through a loop 37,38 of the strap 33 which is stretched to accommodate both members. The loops 37, 38 at the opposite end of the strap 33 is completed in a similar fashion. The second elastomeric band 32 is looped around the shaft 3 of the golf club 1 and hooked under the mounting nub 24 which is centrally located on the lateral base member 21. The placement of the second elastomeric band 32 will depend upon the diameter of the shaft 3 and the length of the elastomeric band. This second elastomeric band 32 may need to be adjusted away from the lateral base member 21 to provide more tension to stabilize the guidance device 20.

The system 10 trains the user by aiding the user in implementing a correct swing in which the longitudinal guide members remain at an equal distance from the ball throughout the swing, and thereby facilitating the maintaining of the club face at a perpendicular orientation to the direction of the swing for a proper contact with the ball. Practice, or repetition of the swing with the training system 10 attached allows muscle memory to "remember" the correct motion when the golf swing is performed without the training device.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A golf club swing training apparatus for removably mounting on a golf club of the type having a shaft and a club head with a face, said system comprising:

a guidance device for removably attaching to a golf club, said guidance device having an elongate lateral base member for mounting in a substantially parallel relationship to the face of a golf club head, and a pair of elongate longitudinal guide members mounted on said lateral base member and extending substantially perpendicular to said lateral base member for extending in a direction substantially perpendicular to the face of the golf club and substantially parallel to the swing direction of a golf club, each said longitudinal guide member being curved along its length such that said longitudinal member curves upward with respect to the ground surface when said device is mounted on a golf club for permitting said longitudinal guide members to clear the ground surface during the swing motion of the golf club, said longitudinal guide members being in a substantially parallel relationship, said longitudinal guide members being laterally spaced apart from each other, said longitudinal guide members being spaced apart a distance greater than about two times the diameter of a golf ball, said longitudinal guide members being spaced apart a distance less than about three times the diameter of a golf ball, a pair of linking members with each linking member extending between an end of said lateral member and an end of a said guide member, each said linking member being oriented substantially perpendicular to said lateral member and substantially perpendicular to said guide member, said linking member being for positioning adjacent to and abutting against the face of the golf club, said lateral base member having a mounting nub thereon at a substantially central location thereon, said lateral base member having a substantially cylindrical shape, each said longitudinal guide member having a substantially cylindrical and arcuate shape, each said linking member having a substantially cylindrical shape, said guidance device additionally comprising connector angles for each joining two of said members together, each said connector angle joining two members in a substantially perpendicular relationship; and mounting means for removably mounting said guidance device to a golf club in a manner such that said longitudinal guide members extend in a perpendicular orientation with respect to the face of the club head, said mounting means comprising an elongate elastomeric member including an elastic strap having opposite ends with each end of said strap being folded over onto itself and being fixed to a middle portion of said strap such that the elastomeric member forms a pair of longitudinally spaced loops, each said loop being for receiving a portion of a guide member and a portion of a club head to secure said guidance device to said club head, and an elastomeric band for wrapping about the shaft of a golf club and hooking about the mounting nub on said lateral base member.

2. A golf club swing training apparatus for removably mounting on a golf club of the type having a shaft and a club head with a face, said system comprising:

a guidance device for removably attaching to a golf club, said guidance device having an elongate lateral base member for mounting in a substantially parallel relationship to the face of a golf club head, and a pair of elongate longitudinal guide members mounted on said lateral base member in a parallel relationship said longitudinal guide members being laterally spaced apart from each other, and extending substantially perpendicular to said lateral base member for extending in a direction substantially perpendicular to the face of the golf club and substantially parallel to the swing direction of a golf club, said lateral base member having a mounting nub thereon at a substantially central location thereon, each said longitudinal guide member having a substantially cylindrical and arcuate shape; and mounting means for removably mounting said guidance device to a golf club in a manner such that said longitudinal guide members extend in a perpendicular orientation with respect to the face of the club head.

3. The golf club swing training apparatus of claim 2, wherein said longitudinal guide members are curved along their length such that each said longitudinal member curves upward with respect to the ground surface when said device is mounted on a golf club for permitting said longitudinal guide members to clear the ground surface during the swing motion of the golf club.

4. The golf club swing training apparatus of claim 2, wherein said longitudinal guide members are spaced apart a distance greater than about two times the diameter of a golf ball.

5. The golf club swing training apparatus of claim 2, wherein said longitudinal guide members are spaced apart a distance less than about three times the diameter of a golf ball.

6. The golf club swing training apparatus of claim 2, wherein said pair of linking members extends between an end of said lateral member and an end of a said guide member, each said linking member being oriented substantially perpendicular to said lateral member and substantially perpendicular to said guide member, said linking member being for positioning adjacent to and abutting against the face of the golf club.

7. The golf club swing training apparatus of claim 2, wherein said lateral base member has a substantially cylindrical shape.

8. The golf club swing training apparatus of claim 2, wherein each said linking member has a substantially cylindrical shape.

9. The golf club swing training apparatus of claim 2, wherein said guidance device additionally comprises connector angles for each joining two of said members together in a substantially perpendicular relationship.

10. The golf club swing training apparatus of claim 2, wherein said mounting means comprises an elongate elastomeric band.

11. The golf club swing training apparatus of claim 10, wherein said elastomeric band is arranged for wrapping about the shaft of a golf club and hooking about the mounting nub on said lateral base member.

12. A golf club swing training apparatus for comprising:

a golf club having a shaft and a club head with a face;

a guidance device removably attached to said golf club, said guidance device having an elongate lateral base member mounted in a substantially parallel relationship to the face of said golf club head, and a pair of elongate longitudinal guide members mounted on said lateral base member and extending substantially perpendicular to said lateral base member such that said guide members extend in a direction substantially perpendicular to the face of the golf club and substantially parallel to the swing direction of the golf club, each said longitudinal guide member being curved along its length such that said longitudinal member curves upward with respect to the ground surface for permitting said longitudinal guide members to clear the ground surface during the swing motion of said golf club, said longitudinal guide members being in a substantially parallel relationship, said longitudinal guide members being spaced apart a distance less than about three times the diameter of a golf ball, said lateral base member having a mounting nub thereon at a substantially central location thereon; and mounting means for removably mounting said guidance device to said golf club in a manner such that said longitudinal guide members extend in a perpendicular orientation with respect to the face of the club head, said mounting means comprising an elastic strap having opposite ends with each end of said strap being folded over onto itself and being fixed to a middle portion of said strap such that the elastomeric member forms a pair of longitudinally spaced loops, each said loop being for receiving a portion of a guide member and a portion of the club head to secure said guidance device to said club head, and an elastomeric band for wrapping about the shaft of the golf club and hooking about the mounting nub on said lateral base member.

13. The golf club swing training apparatus of claim 12, wherein said longitudinal guide members are laterally spaced apart from each other, said longitudinal guide members being spaced apart a distance greater than about two times the diameter of a golf ball.

14. The golf club swing training apparatus of claim 12, having a pair of linking members with each linking member extending between an end of said lateral member and an end of a said guide member, each said linking member being oriented substantially perpendicular to said lateral member and substantially perpendicular to said guide member, said linking member being positioned adjacent to and abutting against the face of said golf club.

* * * * *